US005979948A

United States Patent [19]

Aramburu

[11] Patent Number: 5,979,948

[45] Date of Patent: Nov. 9, 1999

[54] LENGTH-CONVERTIBLE LATCH

[75] Inventor: Luis Angel Ruano Aramburu, San Sebastian, Spain

[73] Assignee: Talleres De Escoriaza, S.A., Spain

[21] Appl. No.: 09/007,610

[22] Filed: Jan. 15, 1998

[30] Foreign Application Priority Data

Jan. 20, 1997 [ES] Spain ..... 9700092

[51] Int. Cl.[6] ..... E05C 1/00

[52] U.S. Cl. ..... 292/1.5; 292/337; 292/DIG. 60; 70/461

[58] Field of Search ..... 292/337, 1.5, 169, 292/DIG. 60; 70/461

[56] References Cited

U.S. PATENT DOCUMENTS

| | | | |
|---|---|---|---|
| 4,687,239 | 8/1987 | Lin | 292/1.5 |
| 4,708,379 | 11/1987 | Chiang | 292/1.5 |
| 4,767,140 | 8/1988 | Lin | 292/337 |
| 4,804,216 | 2/1989 | Marotto | 292/337 |
| 5,020,837 | 6/1991 | Lin | 292/337 |
| 5,074,605 | 12/1991 | Fann et al. | 292/337 |
| 5,149,151 | 9/1992 | Shen | 292/1.5 |
| 5,211,432 | 5/1993 | Lin | 292/337 |
| 5,257,838 | 11/1993 | Lin | 292/1.5 |
| 5,498,037 | 3/1996 | Fan Lai | 292/1.5 |
| 5,613,715 | 3/1997 | Kim | 292/1.5 |
| 5,743,573 | 4/1998 | Huang | 292/DIG. 60 |

*Primary Examiner*—Steven Meyers
*Assistant Examiner*—Teri Pham
*Attorney, Agent, or Firm*—Nields, Lemack & Dingman

[57] ABSTRACT

Length-convertible latch with a front box (2) inside a cylindrical receptacle (7) joined to the rear body (4) with the locking nose (6) fixed lengthwise and with a transverse cavity in the body (4) where the nose (6) can be transversally accommodated against an elastic ring (16) only in its angular position of rest and be disengaged from a first pair (9, 13) of transverse lugs of the driving arm (3) to become located in a second pair (10, 14) of transverse lugs—where arm (3) and body (4) are displaced relatively, and becoming engaged in this new position.

8 Claims, 3 Drawing Sheets

LENGTH-CONVERTIBLE LATCH

FIELD OF THE INVENTION

The purpose of this invention is a latch of the kind that are installed in the edge of a door and that comprise a latch head in which it is elastically retractable on the inside of a front box, whose retractable head is joined at the tip of a driving arm which sticks out behind said front box, being situated and guided lengthwise in a rear body; in this rear body, said driving arm is caused to retract by an eccentric pusher which belongs to a locking nose, which is located with its turning axis directed transversally to said rear body itself, said nose having a square hole to receive a square bar axle, the ends of which are each coupled with rotary action grips which can be a knob or a handle. Said grips are usually joined each to their own escutcheon which are attached to the door and linked together by means of certain tubular bolts with inner threading, which pass through said body and immobilize said latch in its longitudinal direction.

Usually, this type of latch can be actuated in both directions of turning of the nose, so as to make it possible to use it for doors opening to the right or to the left by means of a downward operated handle in both cases, and also to achieve the retraction of the latch head by the turning action of a knob in either of the two directions.

PRIOR STATE OF THE ART

In this field, two distinct values have become standardized for the distance between the square bar axle which produces the opening (retraction of the latch head) and the edge of the door. These two values are 60 mm and 70 mm, and for much time latches have been manufactured exclusively for only one or the other of these measurements.

To overcome this situation, various length-convertible latches have been developed and are known, that is, they have the capability of adapting to one or the other of said measurements, by a more or less complicated and expert manipulation.

In one of the known types, the adaptation is accomplished by lengthwise displacement of the nose along a broad opening formed in both lateral walls of the rear body; in each of these two lengthwise working positions of the nose, the driving arm has a transverse lug which will produce the movement by the eccentric pusher of the nose itself. This solution has conspicuous inconveniences: on the one hand, the considerable structural weakening of the rear body; on the other hand, the need to provide in this rear body the channels which are needed for said threaded tubular bolts in each of said two lengthwise operating positions of the nose, which is a structural complication which frequently requires a lengthwise overdimensioning of said body, and in any case produces an additional weakening of this body.

In another of the known types, the nose moves along with a sliding carriage in which it is installed and which is a kind of needless sleeve in the aforesaid rear body. This solution has essentially the same inconveniences as those mentioned in the preceding paragraph.

Furthermore, in these known types of latch there is an undesirable idle turning movement of the nose before its eccentric pusher begins the retractive action on the driving arm, which has the important disadvantage explained hereafter.

This idle turning, or angular delay in the initial position of the eccentric pusher, is due to the need to overcome the position of the front transverse lug of the driving arm in the lengthwise and rectilinear displacement of this eccentric pusher. The harmful significance of this idle turning is important. For ergonomic reasons, the turning angle of the grip should not exceed 60° (especially in the case of a handle), in order to accomplish the entire longitudinal retraction necessary (approximately 12.7 mm or half an inch) to produce the entering of the latch head into the body, although the majority of known models require travel of 80° to 90°; and every idle turning of the nose is a tuning of the knob or handle which decreases the turning of predetermined magnitude that is necessary for the retraction of the latch head by means of the driving arm. The importance of this problem has led to more complex solutions, such as incorporating in the body a complex and costly mechanism to multiply the lengthwise displacement produced by the turning of the nose; or the reducing of the dimension of the body of the nose to obtain greater length of the arm of the eccentric pusher, but at the cost of the square hole of this nose becoming smaller and diminishing the resistance to the torque and not achieving the values established for this nose by the A.N.S.I. (American National Standards Institute) for a high classification.

In another known type of these latches, the nose performs a combined movement consisting in a three-period maneuver which is composed of, first, a displacement directed transversally to the body and accomplished by manual pressure against an elastic support, second, a lengthwise displacement along the body and by a measure equivalent to that of the solutions previously mentioned, and third, a transverse displacement which is of opposite direction to the first displacement and which is propelled by the elastic spring upon slackening of the manual pressure against the nose. This solution contains the previous problems with respect to the weakening of the rear body and the channel for the tubular threaded bolts. In addition, this solution is vulnerable to a functional problem due to the possibility that the nose might be (undesirably) displaced transversally (first period of the adapted maneuver) and as a result of excess pressure of the head against its locking device, being in a turned position and blocking the turning of the nose because of the unwanted initial operation.

EXPLANATION OF THE INVENTION AND ITS ADVANTAGES

The new convertible latch corresponds to an original design in which said front box is fitted inside a cylindrical receptacle to which are joined the two sides of the rear body in which the locking nose with respect to said rear body in the longitudinal direction and said nose in its initial angular position or position of rest has the active edge of its first and second eccentric pusher opposite, with no play, one of the pairs of transverse lugs of the driving arm and only in this position are the first and second pusher of the nose opposite a first and second transverse cavity made in the driving arm, in which they can be accommodated if a displacement voluntarily occurs transverse to the body against the elastic ring, attaining a lateral position of disengagement in which the driving arm can be displaced lengthwise and change the position of linkage between the first or second pairs of transverse lugs, and whose return of said nose from its disengaged position to its engaged position is possible only when said driving arm is in a state of not being retracted, in which its lengthwise position is such that one or the other of said first front and rear transverse lugs situates its front edge jointly behind the transverse section of the body in which is located the rear edge of said first eccentric pusher; said front box can be displaced along said cylindrical receptacle between certain external positions, front and rear, which are interspaced in a lengthwise channel that is of predetermined amplitude and equal to that between the front edges of said first transverse front and rear lugs; and there being certain means of guidance of said lengthwise displacement of the front and rear box of this front box.

In this new latch, the nose is displaceable only transversally to the rear body and the lengthwise adaptation extent is conferred on the front box with respect to the cylindrical receptacle which makes a single piece with said rear body. Consequently, the rear body does not need any lengthwise window and its structure is not weakened for this reason; furthermore, this rear body remains unchanged before and after the length adaptation conversion, since there is no need to produce two sets of channels for the tubular threaded bolts; instead, a single set of said channels is good for both latch measurements.

Another highly important advantage of the new latch is that there is no loss of effective turning angle (initial idle turning). Now, the first eccentric pusher does not have to overcome the position of the first transverse front lug by a lengthwise and rectilinear displacement; instead, this first eccentric pusher is withdrawn transversally to the first cavity and thus allows the lengthwise displacement of said first transverse front lug when the rear body is put under traction by extending the front box (lengthwise adaptation from 60 mm to 70 mm) or pushed backward when producing its retraction—front box in the cylindrical receptacle (lengthwise adaptation from 70 mm to 60 mm). In the initial turning position of the nose, the first eccentric pusher is applied directly in contact, so that in any case it corresponds from said first transverse front and rear lugs.

Another very important advantage is that the passage between the engaged and disengaged positions of the nose (prior to the lengthwise adaptation) can only occur when this nose is in its position of rest, from which the effective working turn commences, since this initial turning position is the only one in which the first eccentric pusher is opposite the first transverse cavity of the rear box and therefore can be withdrawn from the lengthwise trajectory of the first transverse front lug; also, the initial turning position of the nose is the only one which allows this nose to return between the disengaged and engaged positions. Consequently, there will be no inadvertent lengthwise adaptation mistake capable of causing a turning blockage of the nose when the door is closed; unlike what may occur in some of the above-mentioned known solutions.

The description "first" assigned to certain elements in the new latch is due to the fact that it is of reversible use and there are some elements homologous to those assigned the description "second." Thus, in relation to the working rotation of the nose, the latch is functionally reversible and has a preferable symmetrical layout with respect to the horizontal center plane, such that: said nose has a second eccentric pusher which is applied precisely against the front edge of one or the other of certain second transverse front and rear lugs, which are spaced apart by the measurement of said lengthwise passage between the front and rear positions of said front box; and said rear box has a second transverse cavity which interacts with said second eccentric pusher, in the same way as said first transverse cavity interacts with said first eccentric pusher; in this respect, said transverse cavities, first and second, are formed by a continuous transverse fold of the corresponding lateral wall of said rear body.

The characteristics pointed out thus far for the new latch, as well as others which are mentioned in the following detailed description, will emerge from the preferred embodiment represented on the enclosed drawings.

DRAWINGS AND REFERENCES

In order to better understand the nature of the present invention, on the enclosed drawings we represent a preferred form of industrial embodiment, which is of a merely illustrative and not limiting nature.

FIG. 9 shows, in particular, a partial and conventional cross section of the nose, in order to show clearly the fold forming the first and second transverse cavities.

Figure 1:
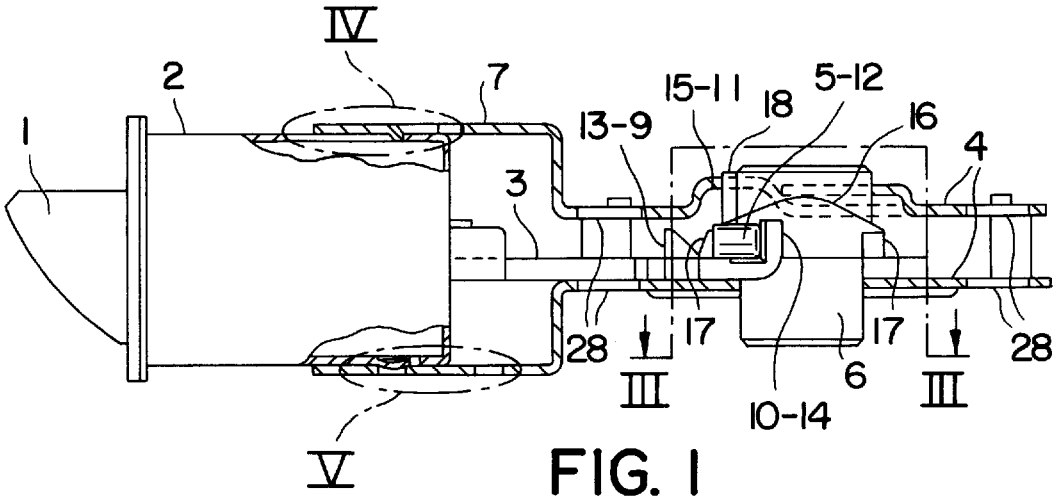
FIG. 1 shows a latch according to the invention, which appears cut through its lengthwise horizontal midplane, except insofar as pertains to the driving arm; the nose and the ring; the state of the latch as shown corresponds to its greatest dimension (for 70 mm).
Figure 2:
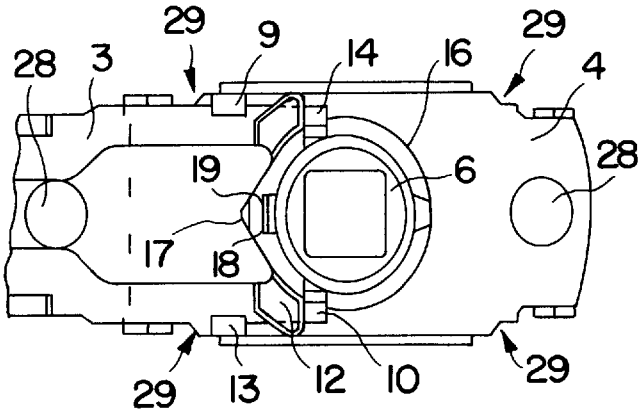
FIG. 2 is the upper plane corresponding to FIG. 1, but referring exclusively to the rear box and having eliminated its wall closest to the observer.
Figure 3:
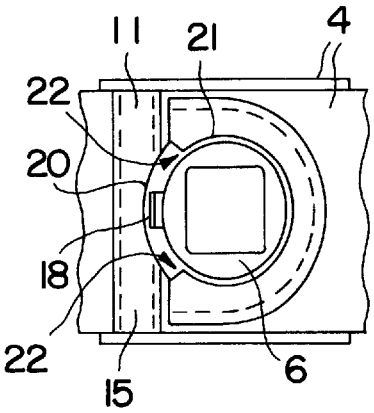
FIG. 3 is the partial upper plane of FIG. 1, corresponding to the indication III—III marked on the latter.
Figure 4:
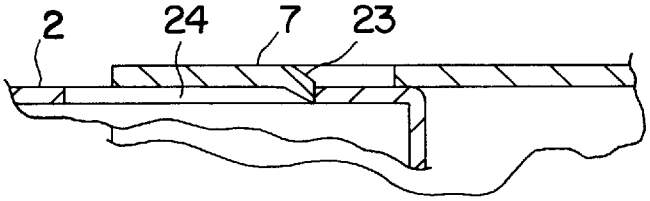
FIGS. 4 and 5 are respective enlargements of features IV and V, encircled in FIG. 1.
Figure 5:
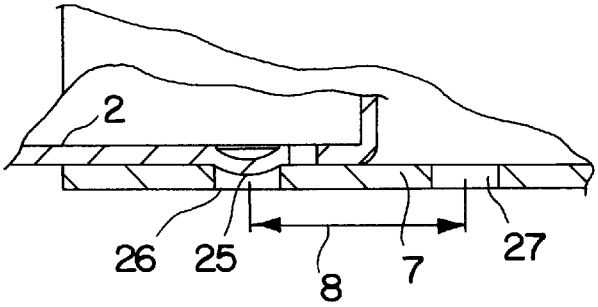
Figure 6:
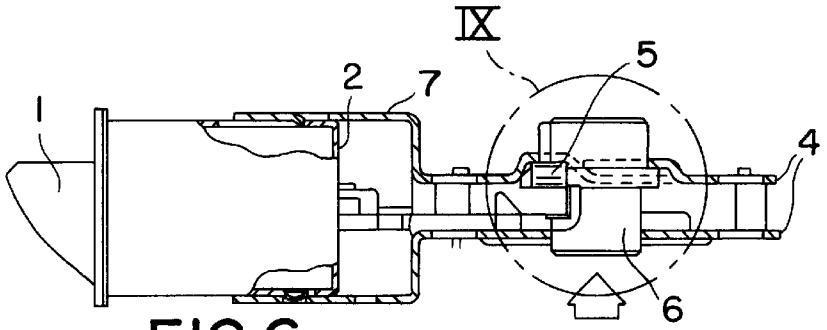
FIGS. 6, 7 and 8 are smaller sized representations of the latch of FIG. 1, illustrating the maneuver of converting same to the smaller dimension (60 mm).
Figure 7:
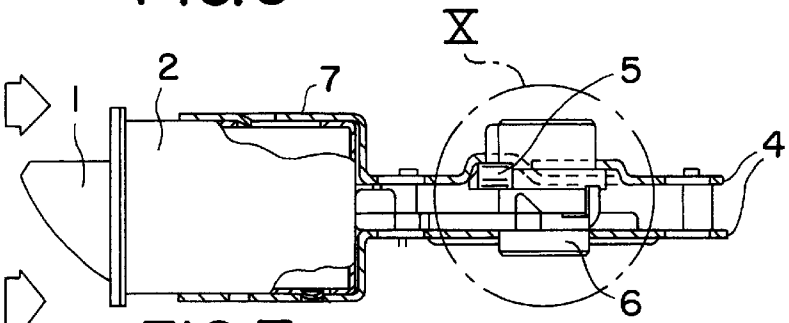
Figure 8:
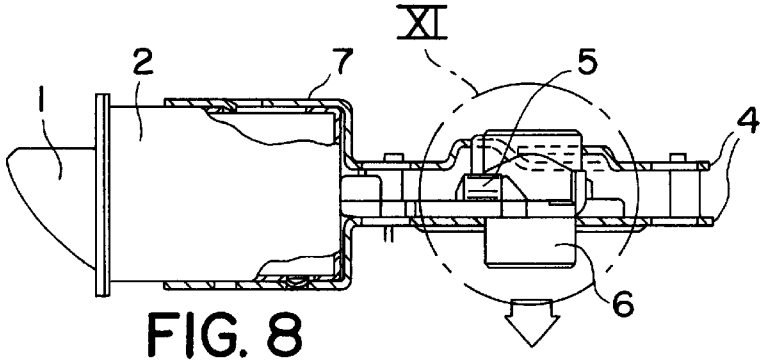
Figure 9:
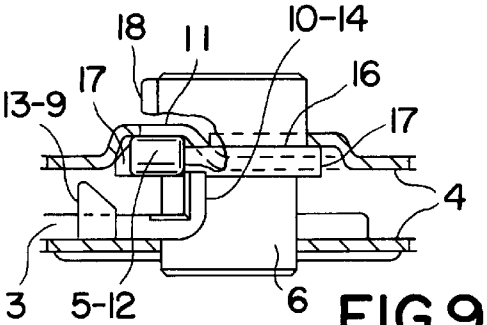
FIGS. 9, 10, 11 are each respective enlargements of features IX, X, XI encircled in FIGS. 6, 7, 8.
Figure 10:
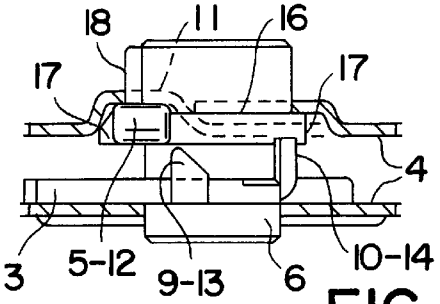
Figure 11:
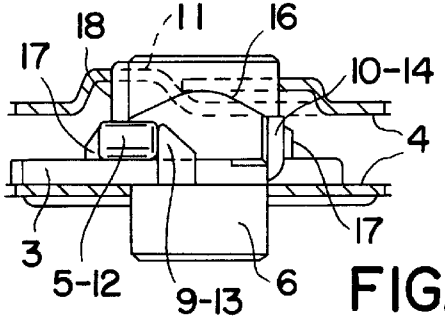
Figure 16:
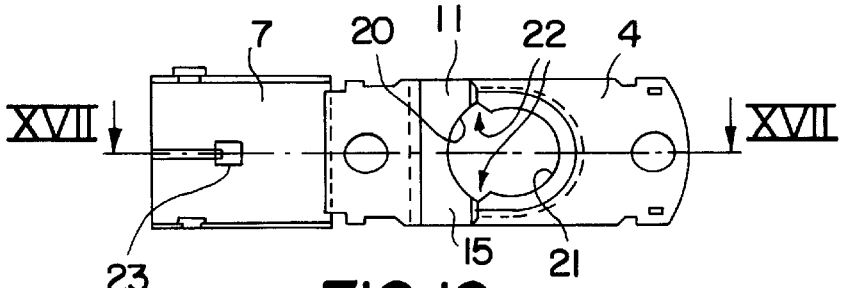
Figure 12:
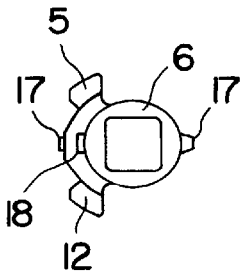
FIG. 12 shows the nose in its position in FIG. 2.
Figure 17:
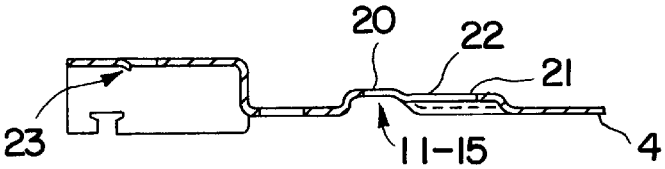
Figure 13:
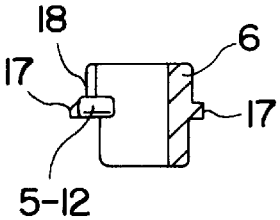
FIG. 13 shows the nose in half-view/half-section corresponding to FIG. 12.
Figure 18:
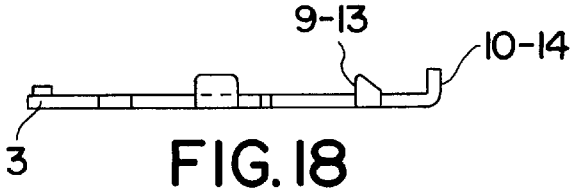
Figure 14:
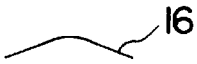
FIG. 14 shows the ring as it appears in FIG. 1.
Figure 19:
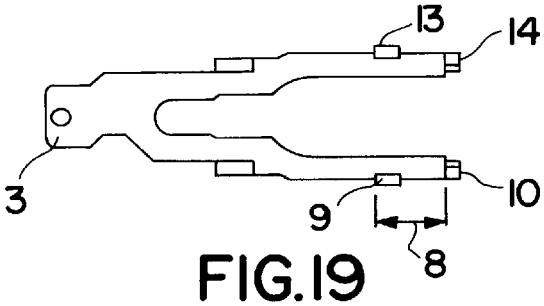
Figure 15:
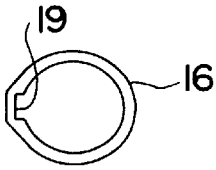
FIG. 15 is the lower plane corresponding to FIG. 14.
Figure 20:
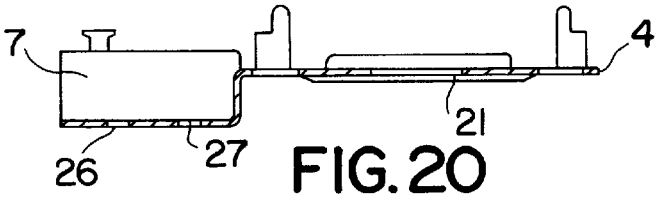
Figure 21:
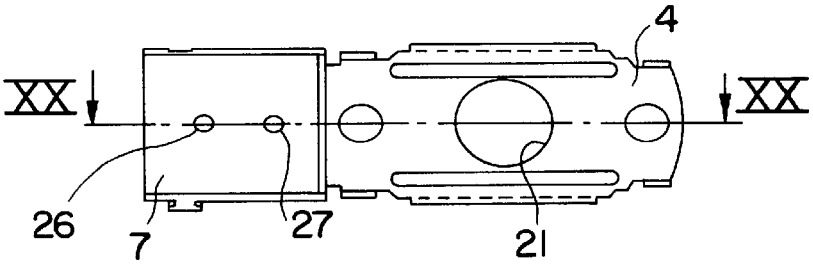

FIGS. 16–21 are a disassemblage of the latch shown in FIG. 1, only as regards the cylindrical receptacle, the rear body and the driving arm; and with respect to a preferential embodiment in which the cylindrical receptacle and the rear body are formed at the same time and continuously by means of two single parts or sides which are joined together with respect to the vertical longitudinal midplane of the latch. FIG. 16 is the side or piece which is in the upper part of FIG. 1, and it is viewed frontally at the inner surface of the rear body. FIG. 17 is section XVII—XVII of FIG. 16. FIG. 18 is the driving arm as seen in FIG. 1. FIG. 19 is a view in upper plane corresponding to FIG. 18. FIG. 20 is section XX—XX of FIG. 21. And FIG. 21 is the side or piece that is in the lower part of FIG. 1, and is viewed frontally at the outer surface of the rear body.

The following references are indicated on these figures:

1. Latch head
2. Front box
3. Driving arm
4. Rear body or tail
5. First eccentric pusher
6. Nose
7. Cylindrical receptacle
8. Lengthwise adaptation step 60/70 mm
9. First transverse front lug of the arm (3)
10. First transverse rear lug of the arm (3)
11. First transverse cavity of the rear body (4)
12. Second eccentric pusher
13. Second transverse front lug of the arm (3)

14. Second transverse rear lug of the arm (3)
15. Second transverse cavity of the rear body (4)
16. Elastic ring
17. Tabs
18. Paraxial rib
19. Radial gap
20. Sectoral channel
21. Orifice
22. Radial stop-edges
23. Wedge
24. Lengthwise window
25. Retraction bump
26. First hole
27. Second hole
28. Passages for tubular threaded bolts
29. Optional passages for support of housing type latch

EXPLANATION OF A PREFERRED EMBODIMENT

With respect to the figures and references mentioned above, the enclosed plans illustrate a preferred embodiment of a new convertible latch that is longitudinally adaptable to two different measurements (in particular, 60 mm and 70 mm) of the distance between the edge of the door and the axis of the actuating grips. The latch is of the general type that is installed in the edge of the door and that comprises a latch head which is elastically retractable within a front box, said latch head being joined at the tip of a driving arm which sticks out behind said front box, being situated and guided lengthwise in a rear body in which said driving arm can be made to retract by at least one first eccentric pusher which belongs to a locking nose, this locking nose having its turning axis directed transversally in a rear body and having a square hole to receive a square bar axle at whose ends are connected actuating grips of knob type or handle type; whose grips are mounted with respect to escutcheons which are mutually fixed by means of tubular threaded bolts which pass through the rear body of the latch.

As illustrated by FIGS. 1, 2, and 12–21, this new latch has a characteristic makeup in which said front box is fitted in a cylindrical receptacle (7) which is joined to a said rear body (4) in which said nose (6) is fixed with respect to the lengthwise direction of said body (4), but in the transverse direction of said body (4) said nose (6) can move against certain elastic means and between certain positions of engaged nose (6) and disengaged nose (6), such that, in said engaged position, said first eccentric pusher (5) is applied against the front edge of one or the other of certain first transverse front (9) and rear (10) lugs which belong to said driving arm (3), and in said disengaged position said first eccentric pusher (5) is temporarily lodged entirely in a first transverse cavity (11) which is in the side of said body (4) toward which said disengaged position is produced, said first transverse cavity (11) being reachable by said first eccentric pusher (5) only when said nose (6) is in its initial position or position of rest, from which commences the working turn that produces said retraction of the latch head (1), and whose return of said nose (6) from its disengaged position to its engaged position is only possible when said driving arm (3) is in a state of nonretraction in which its lengthwise position is such that one or the other of said first transverse front (9) and rear (10) lugs situates its front edge jointly behind the transverse section of the body (4) in which is located the rear edge of said first eccentric pusher (5) when said locking nose (6) occupies said initial turning position; said front box (2) being displaceable along said cylindrical receptacle (7) between certain front and rear positions, which are spaced by a lengthwise step (8) which is of predetermined amplitude and equal to that existing between the front edges of said first transverse front (9) and rear (10) lugs; and there being certain means of guidance of said lengthwise displacement of the front box (2) and certain means of locking said front and rear positions of this front box (2).

Preferably, said means of lengthwise guidance of said front box (2) with respect to said cylindrical receptacle (7) is produced by means of a wedge (23) which sticks out into this cylindrical receptacle (7) and whose wedge (23) is situated with a sliding adjustment relative to a lengthwise window (24) that is produced in the wall of said front box (2) with longitudinal position and extent wedges which allow said wedge (23) to be moved over the full amplitude of the course of said front box (2) between said front and rear lockable positions of the latter, said wedge (23) ending up against the rear end of said window (24) when said lockable front and rear position of said front box (2) are produced by means of an elastic retraction bump (25) which is incorporated in said front box (2) and by means of a pair of holes, first (26) and second (27), which are of circumscribed geometry relative to the periphery of said retraction bump (25), and whose holes (26, 27) are lengthwise spaced by the measurement of said lengthwise step (8) between said front and rear positions of said front box (2).

According to the invention, said transverse elastic displaceability (FIGS. 6–11) of said nose (6) occurs against a ring (16) which embraces the contour of said nose (6) and which adopts a relaxed condition in which said ring (16) produces said engaged position of said nose (6) with the plane of this ring (16) folded at an angle and supported between diametrically opposite tabs (17) of said nose (6) and that lateral wall of said rear body (4) toward which said disengaged position of the nose (6) occurs.

The functionality of longitudinal adaptation or conversion of this new latch is illustrated by means of FIGS. 1, 2 and 6–11. In FIG. 1, the latch is extended to the largest of the aforesaid operating measurements (70 mm), and the nose (6) is engaged with respect to the first transverse rear lug (10) and in the initial rotary position or position of rest; for its part, the front box (2) is in its position protruding the most with respect to the cylindrical receptacle (7), the wedge (23) is against the rear end of the longitudinal window (24), and the retraction bump (25) is lodged in said first hole (26). Now, to change to the position of minimum extent (to the operating measurement of 60 mm), a pressure is applied to the nose (6) (FIGS. 6 and 9), which produces its transverse displacement against the ring (16) (which takes on an essentially flat shape), until the nose (6) is disengaged and the first transverse cavity (11) and away from the section behind the first front lug (9); then, pressure is exerted on the front box (2) (FIG. 7), which becomes unlocked and moves until it comes up against the bottom of the longitudinal window (24) with the flange (23) of the cylindrical receptacle (7), which coincides with the lodging of the retraction bump (25) in the second hole (27) and with the fact that the first eccentric pusher (5) is transversally aligned (FIGS. 7 and 10) with its working position against the front edge of the first transverse front lug (9); this working position is automatically produced (FIGS. 8 and 11) by the elastic recovery of the ring (16) when the pressure on the nose (6) ceases; the longitudinal displacement which has occurred is equal to the predetermined longitudinal step (8) between the two operating conditions (extended and retracted) of the latch, in this particular case, 10 mm. The maneuver of switching between the retracted and extended states of the latch is obvious, without need for further explanation.

As has been explained above, it is usual for these latches to have a reversible makeup which allows the head (1) to be retracted by turning the nose (6) in any direction from its initial position. This new latch is also functionally reversible and has (FIGS. 1 and 2) a preferable symmetrical makeup with respect to the horizontal midplane, such that: said nose (6) has a second eccentric pusher (12) which is applied precisely against the front edge of one or the other of certain second transverse lugs, front (13) and rear (14), which are spaced by the measurement of said longitudinal step (8) between the front and rear positions of said front box (2); and in said rear body (4) there is a second eccentric pusher (12), in the same way as said first transverse cavity (11) behaves with respect to said first eccentric pusher (5).

In this preferred embodiment, said transverse first (11) and second (15) cavities are formed by a continuous transverse fold of the corresponding lateral wall of said rear body (4).

According to another characteristic of the invention, said nose (6) has (FIGS. 12–15) a paraxial rib (18) which is located in a radial gap (19) of the inner edge of said ring (16), and whose paraxial rib (18) protrudes outside said rear body (4) through a channel (20) which narrows a sector of the orifice (21) of this rear body (4) for the assembly of said nose (6), said sectoral channel (20) extending between outermost radial edge-stops (22) which are symmetrically located in both directions of turning with respect to said position of rest of the nose (6). The mutual coupling between said radial gap (19) and paraxial rib (18) ensures a correct working position for the ring (16). And the rotational play of the paraxial rib (18) along the sectoral channel (20) has certain stops which are produced by the radial edge-stops (22), which establishes a mechanical limit to the rotational course of the nose (6) and, thus, for the grip of the knob/handle; this prevents the transmission of extraordinary forces between the nose (6) and the driving arm (3). The integrated constitution of the rear body (4) and the cylindrical receptacle (7) can be designed as two halves joined along the vertical lengthwise midplane (the solution adopted in the preferable embodiment shown); or instead, by separately forming the rear body (4) and the cylindrical receptacle (7), and joining them afterwards inseparably along a transverse plane of the latch.

The rear body (4) has no weakening opening intended for the longitudinal displacement of the nose (6), since only the latter has transverse mobility (along its own axis). This rear body (4) remains unchanged, so that all that is required is a single pair of channels (28) for the two tubular threaded bolts by means of which the mutual connection between the escutcheons of the outside and the inside of the door is accomplished.

The latch incorporates in the rear body (4) optional recesses or channels (29) for when we wish to fasten it with a housing type fastener (of familiar type), instead of being fixed by means of tubular threaded bolts passing through it.

Having sufficiently described the nature of the present invention, as well as its industrial embodiment, it only remains to add that it is possible to make changes of shape, material and arrangement in its totality or constituent parts, within the scope of the invention, insofar as such changes do not vitiate its essence.

What is claimed is:

1. Length-convertible latch for installation in the edge of a door, comprising:

a latch head (1);

a front box (2) within which said latch head (1) is elastically retractable;

a rear body (4) in which a driving arm (3) having a tip and a spaced pair of transverse lugs (9–13, 10–14) is located and guided longitudinally between an extreme front position and an extreme rear position, said latch head (1) being joined at said tip of said driving arm (3), said rear body (4) comprising a first (11) and a second (15) transverse cavity;

a locking nose (6) in said rear body (4), said locking nose (6) having first (5) and second (12) eccentric pushers, said driving arm (3) being retractable by said first (5) or second (12) eccentric pusher, said locking nose (6) having a turn axis directed transversely to said rear body (4), an axial hole for receiving an impelling axle, and a first angular position in which said first (5) and second (12) eccentric pushers abut against one of said pairs of said transverse lugs of said driving arm (3), said nose (6) being transversely displaceable with respect to said rear body (4) between an engaged position and a disengaged position;

biasing means (16) about said locking nose (6);

a cylindrical receptacle (7) joined to said rear body (4), said front box (2) being slidingly received in said cylindrical receptacle (7);

whereby when said locking nose (6) is in said engaged position, said first (5) and second (12) pushers are opposite said first (11) and second (15) transverse cavities, said transverse cavities accommodating said first (5) and second (12) eccentric pushers when said nose is moved transversely to said rear body (4) against said biasing means (16), thereby attaining said disengaged position, allowing said driving arm (3) to be moved into a position in which said first (5) and second (12) eccentric pushers abut against the other of said pair of said transverse lugs of said driving arm (3), the extent of movement of said driving arm (3) and said front box (2) between said extreme front position and said extreme rear position being equal to said space between said pair or transverse lugs.

2. Length-convertible latch, in accordance with claim 1, wherein said rear body (4) has a lateral wall, and wherein said transverse first (11) and second (15) cavities of said body (4) are formed by means of a continuous transverse folding of the corresponding lateral wall of said rear body (4).

3. Length-convertible latch in accordance with claim 2, wherein said biasing means (16) has an inner edge having a radial gap (19), and wherein said nose (6) further comprises a paraxial rib (18) which is located in said radial gap (19) of said inner edge of said biasing means (16), said paraxial rib (18) protruding outside said rear body (4) and riding in a sectoral channel (20) in said rear body (4) during the rotation of said nose (6).

4. Length-convertible latch, in accordance with claim 1, wherein said nose (6) further comprises diametrically opposite tabs (17), and wherein transverse displaceability of said nose (6) is produced against said biasing means (16) which has a form that embraces the contour of said nose (6) and that adopts a relaxed state in which said biasing means (16) produces said engaged position of said nose (6) with the plane of said biasing means (16) folded at an angle and supported between said diametrically opposite tabs (17) of said nose (6) and the wall of said rear body (4) toward which said disengaged position of the nose (6) occurs.

5. Length-convertible latch in accordance with claim 4, wherein said biasing means (16) has an inner edge having a radial gap (19), and wherein said nose (6) further comprises a paraxial rib (18) which is located in said radial gap (19) of said inner edge of said biasing means (16), said paraxial rib (18) protruding outside said rear body (4) and riding in a sectoral channel (20) in said rear body (4) during the rotation of said nose (6).

6. Length-convertible latch, in accordance with claim 1, wherein said biasing means (16) has an inner edge having a radial gap (19), and wherein said nose (6) further comprises a paraxial rib (18) which is located in said radial gap (19) of said inner edge of said biasing means (16), said paraxial rib (18) protruding outside said rear body (4) and riding in a sectoral channel (20) in said rear body (4) during the rotation of said nose (6).

7. Length-convertible latch, in accordance with claim 1, wherein said front box (2) comprises a window (24), and wherein said cylindrical receptacle (7) comprises a wedge (23) which extends into the interior of said cylindrical receptacle (7) and is slidingly received in said window (24) between a first position when said driving arm (3) is in said extreme front position and a second position when said driving arm (3) is in said extreme rear position.

8. Length-convertible latch, in accordance with claim 1, further comprising means for locking of said front and rear positions of said front box (2) comprising an elastic retraction bump (25) that is incorporated into said front box (2) and a pair of first (26) and second (27) holes, which are of circumscribed geometry relative to the periphery of said retraction bump (25), said holes (26 and 27) being longitudinally spaced a distance equal to the distance between said front and rear positions of said front box (2).

* * * * *